United States Patent [19]

Van Laar

[11] Patent Number: 4,778,007

[45] Date of Patent: Oct. 18, 1988

[54] PRODUCING SOUR NATURAL GAS

[75] Inventor: Herman G. Van Laar, Calgary, Canada

[73] Assignee: Shell Oil Company, Houston, Tex.

[21] Appl. No.: 349

[22] Filed: Jan. 5, 1987

[51] Int. Cl.[4] ..... E21B 41/02; E21B 43/12

[52] U.S. Cl. ..... 166/369; 166/50; 166/902

[58] Field of Search ..... 166/50, 369, 370, 902, 166/290

[56] References Cited

U.S. PATENT DOCUMENTS

| | | | |
|---|---|---|---|
| 2,385,298 | 9/1945 | Muskat | 166/369 X |
| 2,434,239 | 1/1948 | Zublin | 166/369 X |
| 2,452,920 | 11/1948 | Gilbert | 166/50 X |
| 4,033,410 | 7/1977 | Kauffman | 166/902 X |
| 4,183,407 | 1/1980 | Knopik | 166/370 |
| 4,257,650 | 3/1981 | Allen | 166/50 X |
| 4,350,600 | 9/1982 | Sharp et al. | 166/902 X |
| 4,410,216 | 10/1983 | Allen | 166/50 X |
| 4,436,165 | 3/1984 | Emery | 166/50 X |
| 4,653,583 | 3/1987 | Huang et al. | 166/50 X |

FOREIGN PATENT DOCUMENTS 346777 11/1978 Austria .

OTHER PUBLICATIONS

Deul et al., *American Gas Assoc. Monthly*, vol. 56, No. 1, Jan. 1974, pp. 4–6.

Hamby, Jr., T. W., et al., "Producing Mississippi's Deep, High-Pressure Sour Gas", *Journal of Petroleum Technology*, Jun. 1976, pp. 629–638.

*Primary Examiner*—George A. Suchfield

[57] ABSTRACT

A sour natural gas is produced via a well system comprising a vertical well section and a horizontal drainhole section extending through the reservoir formation. Formation plugging due to in-situ precipitation of sulphur during production operations is avoided by adequately sizing the horizontal drainhole section in the reservoir, thereby establishing near-wellbore pressures in the reservoir above the sulphur saturation pressure, without sacrificing production rates.

7 Claims, 2 Drawing Sheets

15
10
5
0
$\frac{\Delta P_v}{\Delta P_h}$
0
10
20
30
40
50
L/h 6
5
1
1
7
8
$L_1$
$L_2$

PRODUCING SOUR NATURAL GAS

BACKGROUND OF THE INVENTION

The invention relates to the production of sour natural gas. More particularly, it relates to a method of producing a sour natural gas from a subterranean reservoir formation while preventing plugging of the reservoir formation due to in-situ precipitation of sulphur.

Sour natural gas is able to hold a limited amount of sulphur in solution. The amount of dissolved sulphur increases with the pressure, temperature and hydrogen sulfide content of the gas.

Elemental sulphur comes out of solution when either the pressure or temperature of the fluid drops below the saturation values. Such a change in conditions may easily occur when gas is produced in a production well.

In sour gas production operations via a conventional vertical well, significant amounts of elemental sulphur may be separated from the produced fluid. Depending on the distribution and severity of the pressure and temperature reduction throughout the flow circuit, sulphur deposition is possible in the formation and/or wellbore. For instance, the quantities of sulphur which could potentially separate in a 100,000 $m^3$/ day sour gas producer at an isothermal pressure draw-down from 408 to 375 bar—which could for the greater part occur in the producing formation - may cause the separation of some 1100 kg/day of sulphur.

One of the worst consequences of sulphur deposition is that which takes place in the producing reservoir. Not only can this reduce production, but in extreme cases it can permanently shut off flow into the wellbore, leading to abandonment and the drilling of a replacement well. Formation plugging of this kind becomes more serious as the rock permeability becomes lower. Under these conditions, even the deposition of liquid sulphur in the pores can significantly reduce productivity since the viscosity of the liquid sulphur is much higher than that of the sour gas dense fluid phase.

To produce sour natural gas at a commercial rate of say 100,000 $m^3$/ day via a conventional vertical production well the velocity of the gas through the pores of the reservoir formation at the proximity of the wellbore is inherently high. Due to the high gas velocity required to produce at commercial rates, the reservoir pressure in the proximity of the wellbore easily drops below the sulphur saturation pressure, creating conditions favorable for separation of elemental sulphur.

In field operations preventive and remedial methods have been developed and routinely used to cope with the problem of sulphur deposition in well tubulars. However, no practical, effective methods exist which prevent or remove sulphur deposits formed in the reservoir.

SUMMARY OF THE INVENTION

An object of the invention is to provide a method of producing sour natural gas, wherein deposition of sulphur in the reservoir and in the wellbore traversing the pay zone is avoided without sacrificing production rates.

In accordance with the invention, this object is accomplished by a sour gas production method wherein a well system is drilled and completed into the reservoir formation, which system comprises a substantially vertical wall section extending from the reservoir formation to the surface and a substantially horizontal drainhole section traversing the reservoir formation along a predetermined distance. After completing the well system, gas production is established at such a production rate that at least in the interior of said drainhole section the pressure is above the sulphur saturation pressure.

In a preferred embodiment of the invention the length of said drainhole section is sized in conjunction with a desired production rate of the well system and the thickness of the reservoir formation.

Instead of providing the well system with a single substantially horizontal drainhole section, it may be provided with a plurality of substantially horizontal drainhole sections as well.

BRIEF DESCRIPTION OF THE DRAWINGS

The invention will now be explained in more detail with reference to the accompanying drawings in which.

DESCRIPTION OF THE PREFERRED EMBODIMENT

Figure 1:
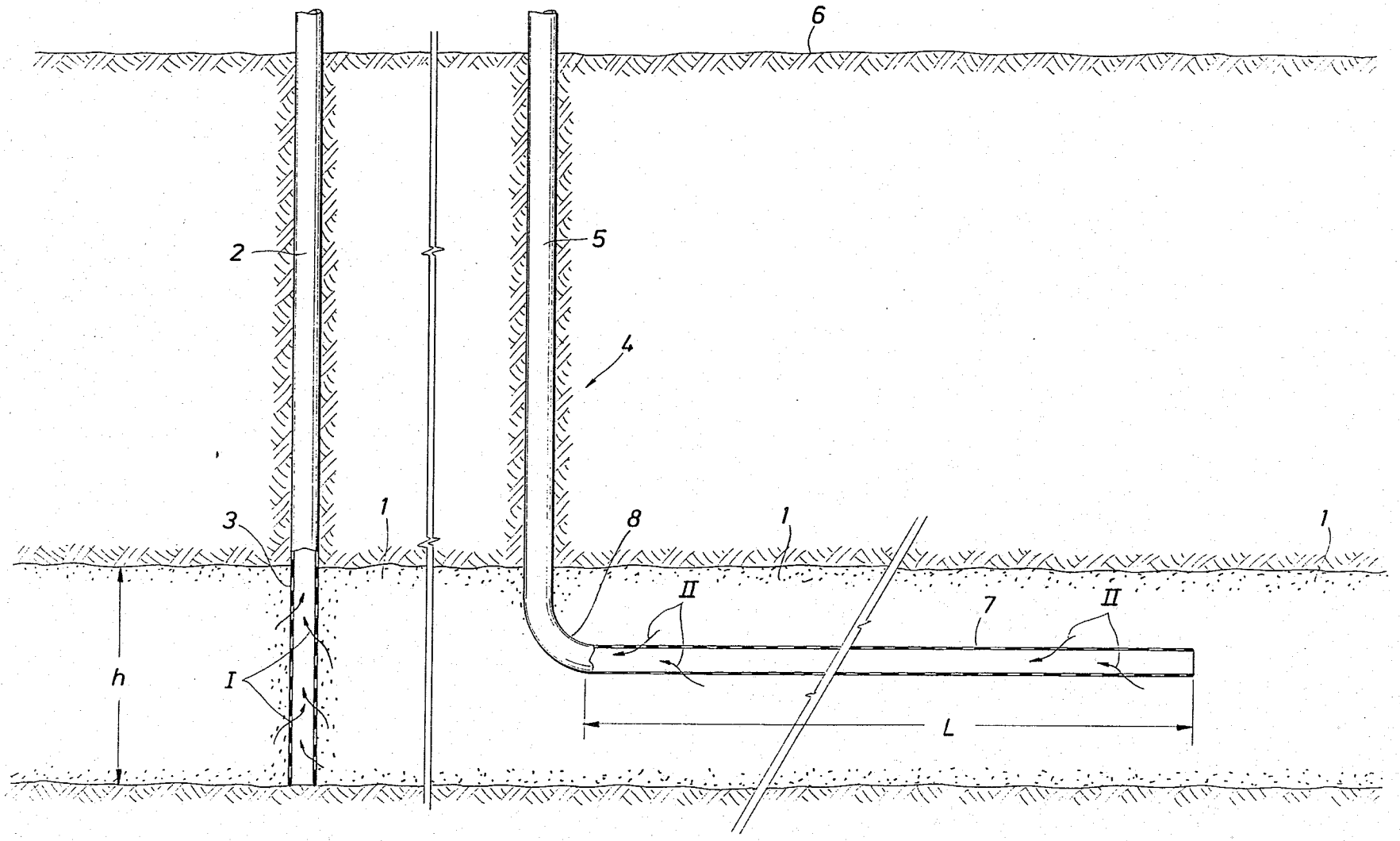
FIG. 1 is a cross-sectional view of a formation illustrating a conventional vertical gas producing well and a well system comprising a substantially horizontal drainhole section producing from the same sour gas reservoir formation.

In FIG. 1 there is shown a subterranean sour gas reservoir formation 1 with an average thickness h and having substantially horizontal upper and lower exterior boundaries.

At the left side of FIG. 1 there is shown a conventional, vertical gas producer well 2 traversing the reservoir formation 1 in a substantially orthogonal direction thereby forming an inflow region 3 extending along the thickness of the reservoir formation 1. As illustrated by arrows I during production gas flows via the permeable wall of the wellbore at the inflow region 3 from the reservoir formation 1 into the well 2.

At the right side of FIG. 1 there is shown a well system 4 according to the invention traversing the same reservoir formation 1. The well system 4 comprises a vertical well section 5 exteding from the earth surface 6 into the reservoir formation 1, a deviated section 8 and a substantially horizontal drainhole section 7.

The drainhole section 7 has a length L and comprises a permeable wall via which gas flows (see arrows II) from the reservoir formation 1 into the well system 4.

As will be explained hereinbelow the lengthL of the permeable drainhole section 7 in the reservoir formation 1 is an important parameter with regard to avoiding in-situ precipitation of sulphur in the pores of the reservoir formation 1 in the proximity of the wellbore.

In-situ precipitation of sulphur in the formation is controlled by the difference between the pressure deep in the reservoir ($P_e$) and that in the borehole during production ($P_b$). This pressure difference, commonly called "draw-down" $\Delta P$, is the function of the well, fluid and rock characteristics. For the conventional vertical well 2 the draw-down $\Delta P_v$ can be derived from Darcy's law for the radial flow of gas:

$$\Delta P_v = P_e - \sqrt{P_e^2 - \frac{Q \cdot P_{sc} \cdot T \cdot z \cdot \mu}{T_{sc} \cdot \pi \cdot K \cdot L} \ln \frac{r_e}{r_w}} \quad (1)$$

where $\Delta P_v = P_e - P_{bv}$ = draw-down, vertical hole, bar.

$P_e$ = Reservoir pressure at the exterior boundary, bar
$P_{bv}$ = Borehole pressure, vertical hole, bar
$P_{sc}$ = Pressure at standard conditions, bar
Q = Gas production rate at standard conditions, $cm^3$/sec.
T = Absolute reservoir temperature, °K.
$T_{sc}$ = Absolute temperature at standard conditions, °K.
z = Gas compressibility factor at the average pressure in the drainage system considered
$\mu$ = Viscosity of gas under reservoir conditions, cP
K = Rock permeability, D
h = Net formation thickness, cm
$r_e$ = Radius of exterior boundary, cm
$r_w$ = Well bore radius, cm Equation (1) is applicable to isotropic formations, unimpaired by skin damage and penetrated by a conventional, vertical well.

Based on equations used by Giger et al (Giger, F. M., Reiss, L. H. and Jourdan, A. P., "The Reservoir Engineering Aspects of Horizontal Drilling", SPE 13024, September 1984), the following relationship between the draw-down $\Delta P_h$ and the various well, fluid and rock characteristics can be derived for the inflow of gas into the horizontal drain hole section 7:

$$\Delta P_h = P_e - \sqrt{P_e^2 - \frac{Q \cdot P_{sc} \cdot T \cdot z \cdot \mu}{T_{sc} \cdot \pi \cdot K \cdot L} \left[ \frac{L}{h} \ln \left( \frac{1 + \sqrt{1 - \left(\frac{L}{2r_e}\right)^2}}{\frac{L}{2r_e}} \right) + \ln \frac{h}{2\pi r_w} \right]} \quad (2)$$

where $\Delta P_h = P_e - P_{bh}$
L = Length of horizontal drainhole section, cm
$P_e$ = Reservoir pressure at the exterior boundary, bar
$P_{bh}$ = Borehole pressure, horizontal drainhole, bar
$P_{sc}$ = Pressure at standard conditions, bar
Q = Gas production rate at standard conditions, $cm^3$/sec.
T = Absolute reservoir temperature °K.
$T_{sc}$ = Absolute temperature at standard conditions, °K.
z = Gas compressibility factor at the average pressure in the drainage system considered
$\mu$ = Viscosity of gas under reservoir conditins, cP
K = Rock permeability, D
h = Net formation thickness, cm
$r_e$ = Radius of exterior boundary, cm
$r_w$ = Well bore radius, cm In the following example it is assumed that sour gas containing 80% $H_2S$ is produced.

When considering the methane—hydrogen sulphide—sulphur equilibrium, the following saturation sulphur contents were determined for various pressure and temperature conditions:

GAS COMPOSITION: $CH_4$ 20%, $H_2S$ 80%

| Pressure Bar | Temperature °C. | Sulphur Content $g/m^3$ |
|---|---|---|
| 408 | 121.1 | 40.0 |
| 408 | 65.6 | 19.2 |
| 204 | 121.1 | 6.4 |
| 204 | 65.6 | 4.6 |

It may be seen that a decrease in temperature from 121° C. to 66° C. more than halves the saturation sulphur content of the 408 bar gas. A pressure reduction to 204 bar further reduces the sulphur content to almost one tenth of the original value. It is evident that the pressure effect is more dominant that the temperature effect.

It is further assumed that the gas is produced at a rate of 100,000 $m^3$/ d from a low permeability reservoir (10 mD) which has a $P_e$ of 412.5 bar and a static temperature of 124° C. The other characteristics are assumed to be:

| | | |
|---|---|---|
| Net formation thickness, | 15 | m |
| Radius of exterior boundary, | 400 | m |
| Well bore radius, | 0.11 | m |
| Gas compressibility factor, | 0.7 | |
| Viscosity of gas under reservoir conditions, | 0.075 | cP |
| Pressure $P_{sc}$ at standard conditions | 1 | bar |
| Temperature $T_{sc}$ at standard conditions | 288 | k |

Using equation (1), the draw-down $\Delta P_v$ in the vertical well 2 for the given conditions is calculated to be 18.1 bar, indicating that the borehole pressure drops from 412.5 to 394.4 bar, well below the saturation pressure (408 bar). This implies that sulphur separation in the formation is exceptable.

Then a 350 m horizontal drainhole section is considered assuming the same formation, fluid and well characteristics as for the vertical well example.

Under the assumed well conditions, the draw-down for the horizontal drainhole is calculated using equation (2) to be only 3.5 bar, indicating a borehole pressure of 408 bar, just above the saturation pressure (408 bar). Therefore, no sulphur separation in the formation is to be expected. However, as the difference between borehole and saturation pressure is only marginal (1 bar), a longer horizontal hole should be chosen. It may be calculated that for a horizontal length of 450 m, the borehole pressure drops to 409.7 bar, almost 2 bar above the saturation pressure.

In order to easily compare the pressure draw-down of a vertical well with that of a horizontal well producing at the same rate from the same reservoir, the ratio of equations (1) and (2) can be written in a more convenient form as follows:

$$\frac{P_e^2 - P_{bv}^2}{P_e^2 - P_{bn}^2} = \quad (3)$$

-continued $$\frac{\ln \frac{r_e}{r_w}}{\ln\left(\frac{1+\sqrt{1-\left(\frac{L}{2r_e}\right)^2}}{\frac{L}{2r_e}}\right)+\frac{h}{L}\ln\frac{h}{2\pi r_w}}$$

Equation (3) shows that for a given reservoir where $P_e$, $r_e$, h and $r_w$ remain the same and Q is not changed, the pressure draw-down for a horizontal hole decreases as the horizontal length L increases. The effect of L on the draw-down is further illustrated in FIG. 2, where the draw-down ratio $\Delta P_v/\Delta P_h$ is plotted as a function of the dimensionless horizontal length (L/h). This graph can be used to estimate the minimum length of the horizontal section required to achieve a given maximum allowable draw-down.

Figure 2:
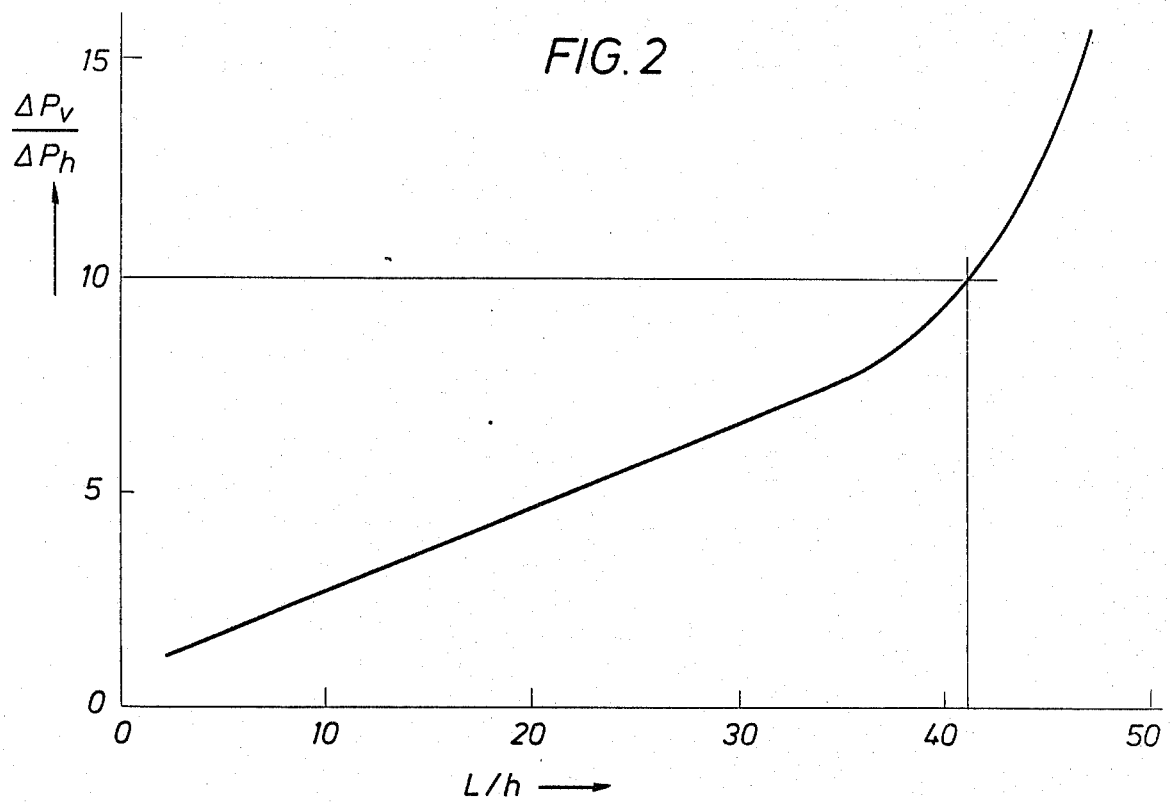
FIG. 2 is a graph in which the ratio ($\Delta P_v/\Delta_h$) of the pressure draw-down of a gas flowing into the vertical well and that of the gas flowing into the horizontal drainhole is plotted against the dimensionless horizontal length (L/h) of the drainhole.

FIG. 2 further illustrates that the horizontal wellbore length L in the reservoir is the dominating parameter with regard to establishing minimum draw-down; and that under the assumed well conditions a horizontal hole 40 times longer than the reservoir thickness exhibits pressure draw-down ten times less than those in a vertical hole through the same reservoir, producing at the same rate.

By extending the horizontal length of a drain hole it is not only possible to avoid in-situ sulphur separation but also to achieve this at increased production rates. By applying equation (2) with the assumed well and reeservoir conditions it can be demonstrated that if the horizontal hole length is extended by about 25%, the production rate can be increased by about 20% at the same draw-down.

Figure 3:
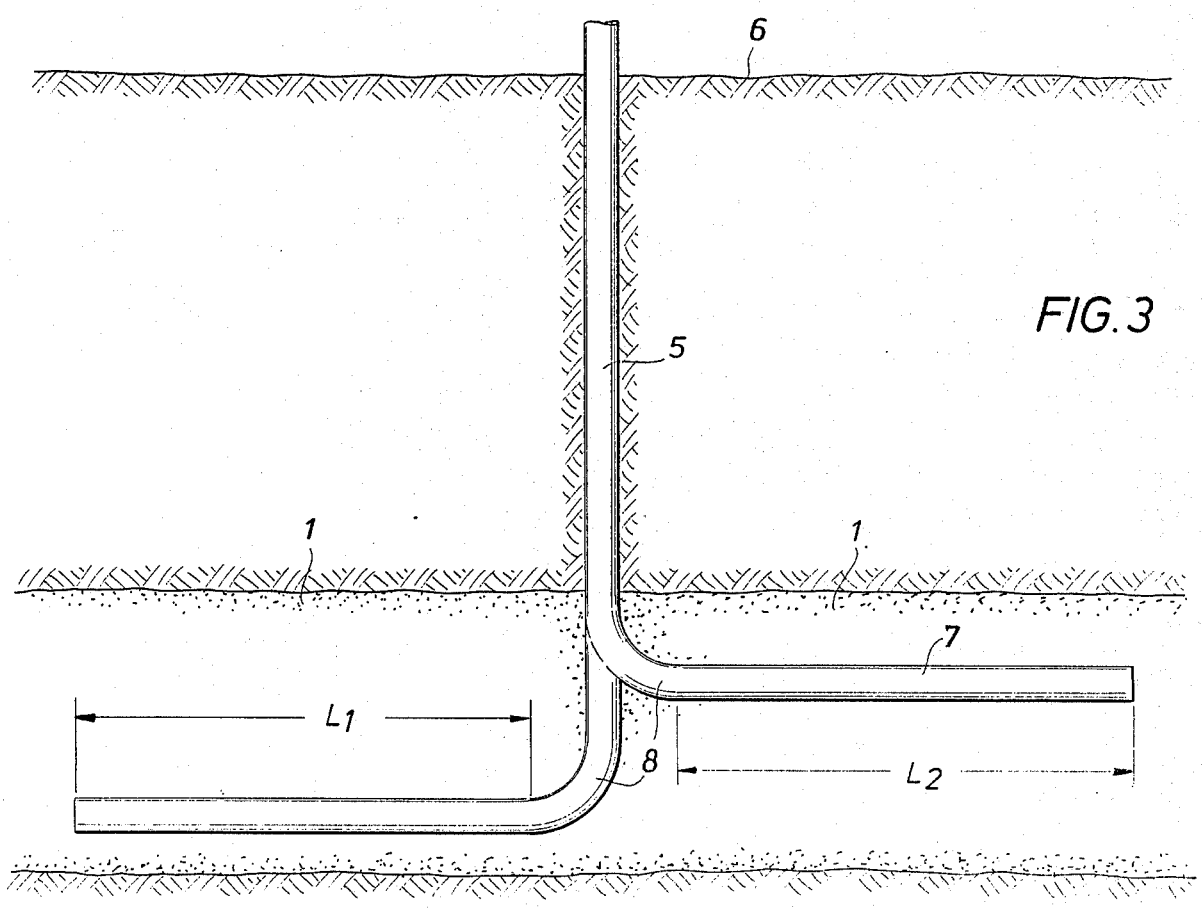
FIG. 3 is a cross-sectional view of a formation illustrating a sour gas producer well system comprising two horizontal drainhole sections drilled from a single vertical well section.

Furthermore, as illustrated in FIG. 3, modern horizontal well drilling techniques enable operators to drill more than one horizontal hole from a single vertical well. This can be considered as an alternative if further extension of a single horizontal well is desirable but technically not possible. The total production capacity of the well system is controlled by the sum of the lengths $L_1$ and $L_2$ of both horizontal sections.

This all implies that from a single horizontal well system considerably higher production rates are possible than from a single vertical well without inducing in-situ sulphur separation.

Moreover, production of sour natural gas via a well system according to the invention instead of via conventional vertical wells has the advantage of enhanced safety, because a reduced number of surface production points (well heads) and surface flowlines are required to produce sour gas at the desired rates.

What is claimed is:

1. A method of producing a sour natural gas from a subterranean reservoir formation in which the gas pressure is above the sulphur saturation pressure, the method comprising:

completing a well system into said formation, said well system comprising a substantially vertical well section extending from the reservoir formation to the surface and a substantially horizontal drainhole section traversing the reservoir formation along a predetermined distance, length (L) which is determined such that the difference ($\Delta P_h$) between the gas pressure at the exterior boundary of the reservoir ($P_e$) and that in the interior of the reservoir ($P_{bh}$) maintains the gas pressure ($P_{bh}$) on the interior above the sulphur saturation pressure for a desired gas production rate; and establishing gas production via the completed well system at the desired production rate whereby, at least in the interior of said drainhole section, the pressure of the produced fluid is above the sulphur saturation pressure.

2. The method of claim 1, wherein the length (L) of the horizontal drainhole section is determined as a function of the desired production rate of the well system and the thickness of the reservoir formation.

3. The method of claim 2, further comprising:

first determining a maximum acceptable difference $(\Delta P_h)A$ between the gas pressure at the exterior boundary of the reservoir ($P_e$) and that in the interior of the drainhole section ($P_{bh}$) to maintain the gas pressure ($P_{bh}$) in said interior above the sulphur saturation pressure;

subsequently calculating a difference $\Delta P_h$ between $P_e$ and $P_{bh}$ for various values of said length (L) on the basis of the relationship:

$$\Delta P_h = P_e - \sqrt{P_e^2 - \frac{Q \cdot P_{sc} \cdot T \cdot z \cdot \mu}{T_{sc} \cdot \pi \cdot K \cdot L}\left[\frac{L}{h}\ln\left(\frac{1+\sqrt{1-\left(\frac{L}{2r_e}\right)^2}}{\frac{L}{2r_e}}\right)+\ln\frac{h}{2\pi r_w}\right]} \quad (2)$$

where:

$\Delta P_h = P_e - P_{bh}$

L=Length of horizontal drainhole section, cm $P_e$=Reservoir pressure at the exterior boundary, bar $P_{bh}$=Borehole pressure, horizontal drainhole, bar $P_{sc}$=Pressure at standard conditions, bar Q=Gas production rate at standard conditions, $cm^3$/sec.

T=Absolute reservoir temperature °K $T_{sc}$=Absolute temperature at standard conditions, °K.

z=Gas compressibility factor at the average pressure in the drainage system considered $\mu$=Viscosity of gas under reservoir conditions, cP K=Rock permeability, D h=Net formation thickness, cm $r_e$=Radius of exterior boundary, cm $r_w$=Well bore radius, cm and then determining a length (L) for which $\Delta P_h < (\Delta P_h)_A$.

4. The method of claim 2, wherein the length of the substantially horizontal drainhole section is at least 30 times the reservoir thickness.

5. The method of claim 1, wherein the well system comprises a single substantially vertical well section and a plurality of substantially horizontal drainhole sections arranged in fluid communication with the vertical well section and traversing the reservoir formation in various directions.

6. The method of claim 5, wherein the accumulated lengths of said substantially horizontal drainhole sections is at least 30 times the thickness of the reservoir formation.

7. The method of claim 1, wherein the sour natural gas comprises about 20% weight methane and about 80% weight hydrogen sulfide.

* * * * *